United States Patent [19]

Pool

[11] 4,240,568

[45] Dec. 23, 1980

[54] ATTACHMENT FOR LIQUID CARRYING CONTAINER

[75] Inventor: Danny L. Pool, Phoenix, Ariz.

[73] Assignee: Robert R. Pool, Phoenix, Ariz.

[21] Appl. No.: 912,207

[22] Filed: Jun. 5, 1978

Related U.S. Application Data

[63] Continuation-in-part of Ser. No. 853,218, Nov. 21, 1977, abandoned.

[51] Int. Cl.[3] ..... B65D 25/48

[52] U.S. Cl. ..... 222/189; 222/570; 220/855 P; 220/90

[58] Field of Search ..... 222/570, 189, 543; 220/85 SP, 90

[56] References Cited

U.S. PATENT DOCUMENTS

| | | | |
|---|---|---|---|
| 2,471,189 | 5/1949 | Bartels | 222/570 X |
| 2,627,367 | 2/1953 | Bore | 222/570 |
| 2,753,051 | 7/1956 | Tupper | 222/189 X |
| 3,113,706 | 12/1963 | Wickman | 222/570 X |
| 3,221,955 | 12/1965 | Banaszak et al. | 222/570 |
| 3,239,113 | 3/1966 | Knize | 220/90 UX |
| 3,295,726 | 1/1967 | Hanson | 222/543 X |
| 4,014,465 | 3/1977 | Ritter | 220/90 X |

FOREIGN PATENT DOCUMENTS

| | | | |
|---|---|---|---|
| 24804 | 7/1919 | Denmark | 222/189 |
| 556053 | 9/1943 | United Kingdom | 222/189 |

*Primary Examiner*—Robert J. Spar
*Assistant Examiner*—Frederick R. Handren
*Attorney, Agent, or Firm*—Don J. Flickinger

[57] ABSTRACT

A body member is detachably engageable with the brim of a liquid carrying container and includes an annular ledge which sealingly resides over the gutter of the brim. The ledge has an upstanding outer peripheral rim which redirects fluid into the container. A screen filters fluid passing from the container to a pouring spout extending radially from the ledge. A hingedly affixed closure member sealingly engages the body member for airtight storage of the liquid.

2 Claims, 10 Drawing Figures

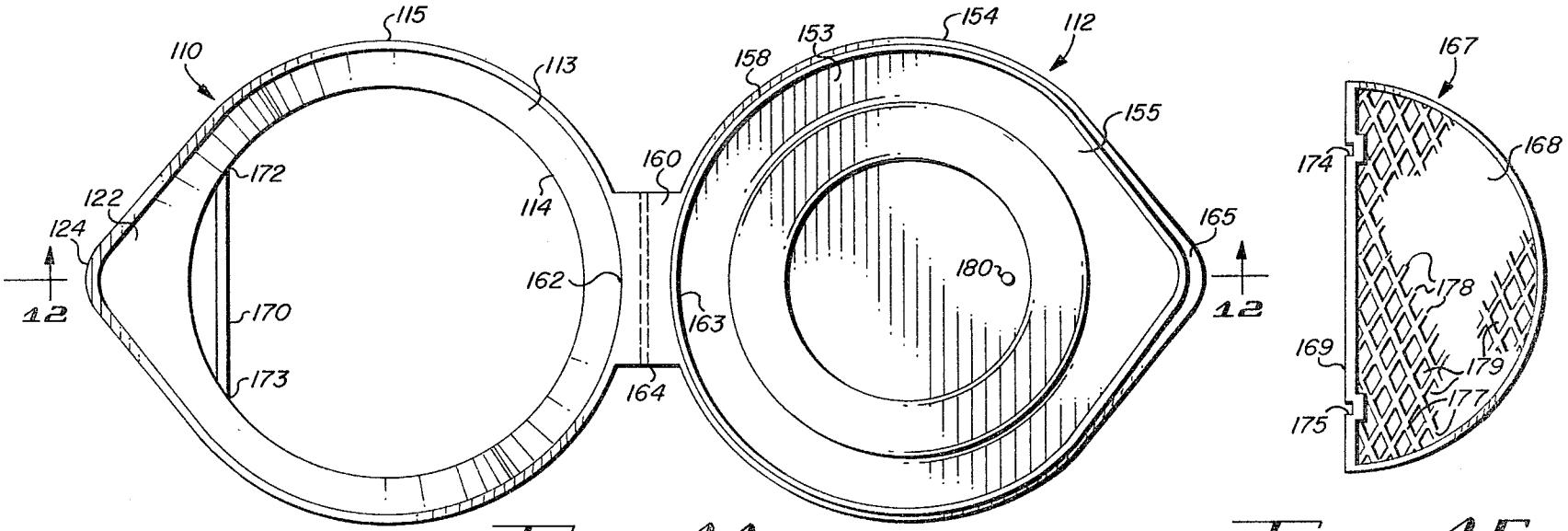
FIG. 11
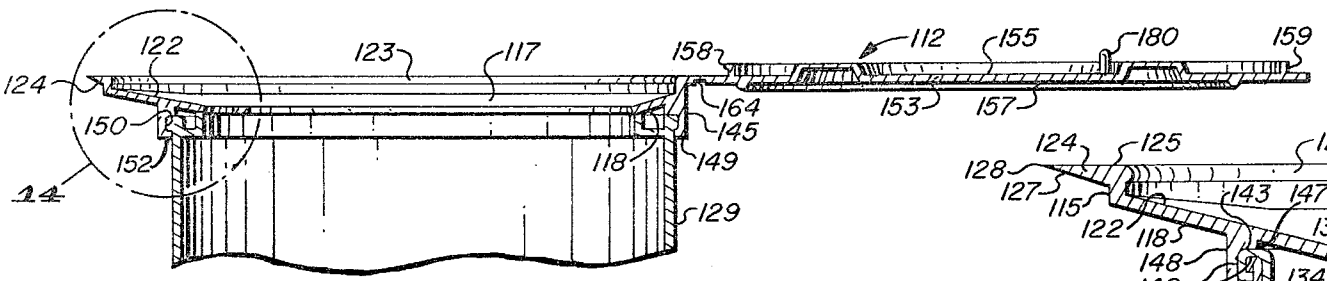
FIG. 12
FIG. 15
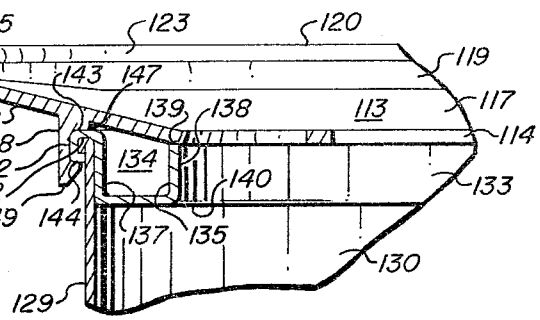
FIG. 14
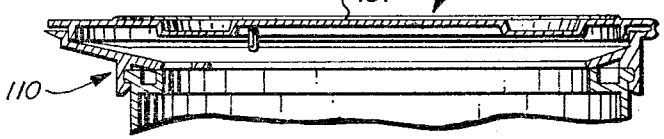
FIG. 13

ATTACHMENT FOR LIQUID CARRYING CONTAINER

The instant application is a continuation-in-part application of the common inventor's prior filed, once copending, now abandoned application Ser. No. 853,218, filed Nov. 21, 1977, entitled "SPILL RETARDING ATTACHMENT FOR CONTAINER".

This invention relates to containers of the type having a brim with a gutter and normally used for storing and dispensing liquids, such as paint.

More particularly, the present invention concerns an attachment having a pouring spout and which prevents the accumulation of liquid within the gutter.

In further aspect, the instant invention concerns an improved container attachment having an integral closure member.

Containers of the type commonly used for storing liquids, such as paint and cooking oils, are well known. Briefly, the conventional container includes a generally cylindrical sidewall with a closed bottom and an annular brim at the upper edge. The brim has an annular gutter which sealingly engages a flange depending from a cylindrical lid.

In accordance with conventional practice, liquid is frequently dispensed directly from the container by means of a brush, which is dipped into the liquid.

As the brush is withdrawn from the container, exess liquid is removed by wiping the brush over the inner periphery of the brim. Eventually, as a result of this practice, the gutter fills with the liquid which subsequently overflows over the outside of the container. In addition to the potential loss of liquid, untidy conditions and unsightliness, the liquid must be removed from the gutter prior to replacing the lid.

The prior art is replete with various devices which purportedly provide solutions to the foregoing problems. A search of the United States Patent and Trademark Office Records, conducted in Class 220, Subclass 90, and Class 222, Subclasses 570, 566 and 569, revealed the following issued U.S. Pat. Nos.:

3,980,213 3,733,015 3,688,943 3,463,366 3,275,187 3,135,441 3,113,706

In general, the foregoing patents disclose a body member having an annular ledge which is positioned over the gutter of the brim. An annular member depends from the gutter and engages the inner periphery of the brim. An upturned rim at the outer edge of the ledge prevents fluid from spilling over the outside of the container. Frequently, the devices include a pouring spout.

Typical of the foregoing general description is the device disclosed by U.S. Pat. No. 3,463,366. U.S. Pat. No. 3,733,105 illustrates a hingedly affixed lid which is secured to the body member by a snap engagement. The lid and the body member taken together define the pouring spout. A cylindrical member depending from the lid sealingly engages the inner periphery of the ledge for the purpose of sealingly closing the container, in accordance with U.S. Pat. No. 3,113,706.

A closure member is not disclosed nor suggested in U.S. Pat. No. 3,463,366. The closure member, having a cylindrical member which engages the opening within the ledge, of U.S. Pat. No. 3,113,706, prevents the return flow of liquid from the ledge. The lid, as described in U.S. Pat. No. 3,733,015, while protecting the contents of the container from settling dirt and dust, does not hermetically seal the contents.

Various problems associated with the prior art are not addressed by the foregoing references. For example, liquid frequently becomes contaminated with particulate matter, such as the film that forms on the top of paint, or the lumpy masses which form in reused cooking oil. Further, the prior art devices have created new problems. Exemplary, is the fact that several of the attachments must be removed and cleaned for storage, during which time the original lid is replaced upon the container. Also, the prior art attachments are generally arranged such that the weight of the liquid during pouring can lift and dislodge the gutter sealing means and the engagement member.

It would be highly advantageous, therefore, to remedy the deficiencies inherent in prior art attachment devices.

Accordingly, it is an object of the present invention to provide an improved attachment for liquid carrying containers.

Another object of the invention is the provision of an attachment which is detachably securable to the brim.

And another object of the invention is to provide means for preventing the accumulation of liquid within the gutter of the brim.

Still another object of the invention is to retard spillage over the side of the container and redirect potentially spilled liquid into the container.

And still another object of the invention is to provide an attachment which will assist in pouring liquid from a container.

A further object of the invention is the provision of an attachment having means for removing excess liquid from a brush.

And a further object of the invention is to provide an attachment with the closure member for sealing the container when not in use.

Yet a further object of the invention is the provision of an attachment wherein the liquid upon the ledge will drain and and return to the container during the storage with the closure member in place.

And yet a further object of the invention is to provide means for optionally straining liquid poured from the container.

Still a further object of the invention is the provision of an attachment which securely grips the brim and will not be dislodged due to the weight of liquid during pouring.

And still another object of the invention is to provide an attachment which is readily transferable from one container to another.

Yet a still further object of the instant invention is the provision of an attachment of the above type which is economically produced and durably constructed.

Briefly, to achieve the desired obects of the instant invention in accordance with a preferred embodiment thereof, first provided is a body member including an annular ledge which extends over the gutter within the brim of the container. Engagement means depend from the bottom of the ledge and detachably secure the ledge to the brim. A pouring spout extends radially from the ledge and has upturned edges which are continuous with a rim upstanding proximate the outer periphery of the ledge. Next provided is a closure member including a panel which extends over the opening within the annular ledge and has a continuous depending skirt which sealingly engages the body member. The closure member is hingedly affixed to the body member.

A brush wiping bar extends as a cord across the opening in the annular ledge and is spaced from the pouring spout. A screen element intermediate the pouring spout and the brush wiping bar strains liquid poured from the container. The screen may be integral with the body member or, alternately, detachably engageable at the option of the user.

In accordance with a preferred embodiment, the ledge is directed downwardly inward for draining liquid. The skirt of the closure member detachably engages the rim of the body member to provide for draining during storage after the closure member is in place. The engagement means of the body member engages the outer edge of the brim and urges the ledge downwardly in sealing engagement against the inner edge of the gutter.

The foregoing and further and more specific objects and advantages of the instant invention will become readily apparent to those skilled in the art from the following detailed description of the preferred embodiments thereof, taken in conjunction with the drawings, in which:

FIG. 11 is a top plan view of another alternate attachment for liquid carrying containers constructed in accordance with the teachings of the instant invention;

FIG. 12 is a vertical sectional view taken along the line 12—12 of FIG. 11 and showing the device thereof as it would appear when secured to the upper edge of a conventional liquid carrying container, the attachment device of the instant invention being shown in the open position;

FIG. 13 is a view generally corresponding to the view of FIG. 12 and showing the device thereof in the closed position;

FIG. 14 is an enlarged fragmentary sectional view as indicated within the broken outline area designated 15 in FIG. 12;

FIG. 15 is a plan view of a liquid straining element useful in connection with the embodiment of FIG. 11;

Figure 16:
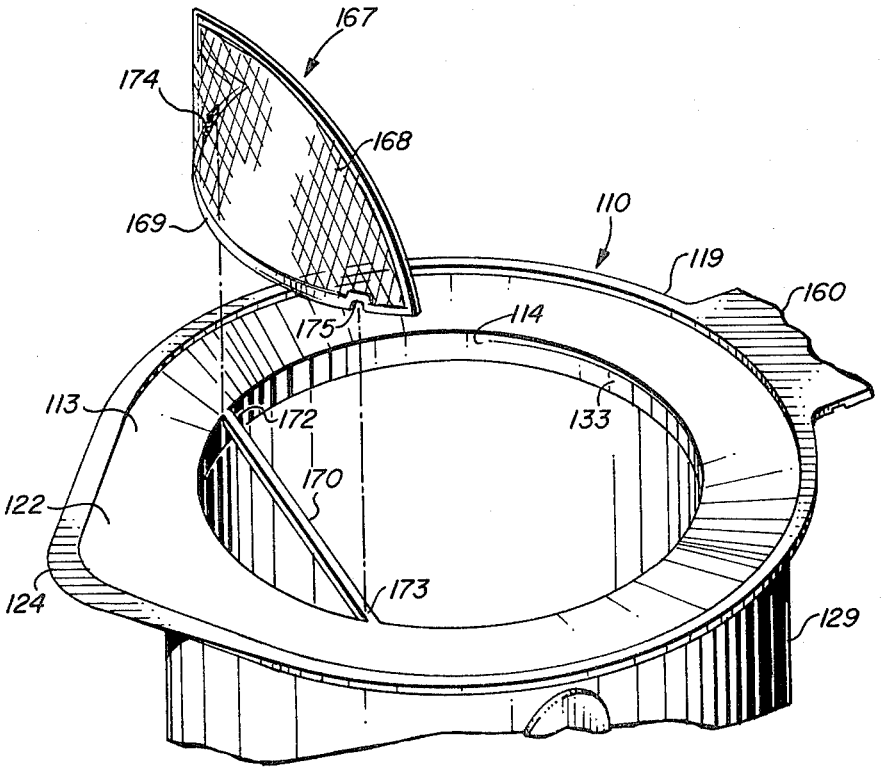
Figure 17:
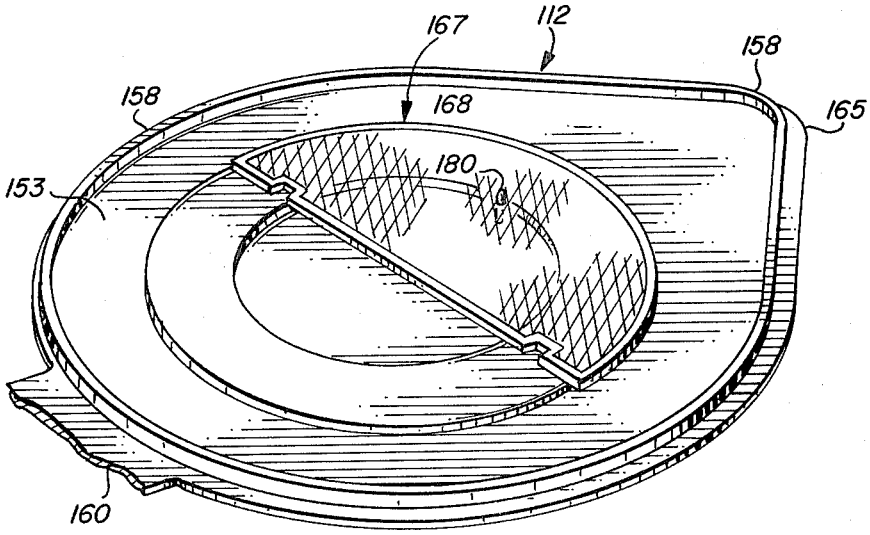

FIG. 16 is a partial perspective view, especially showing the body portion of the instant invention as it would appear when attached to a conventional container, the straining element of FIG. 14 being shown in exploded illustration; and FIG. 17 is a partial perspective view of the devices of the instant invention, especially showing the closure member as it would appear when having the straining element of FIG. 14 detachably secured thereto.

Figure 1:
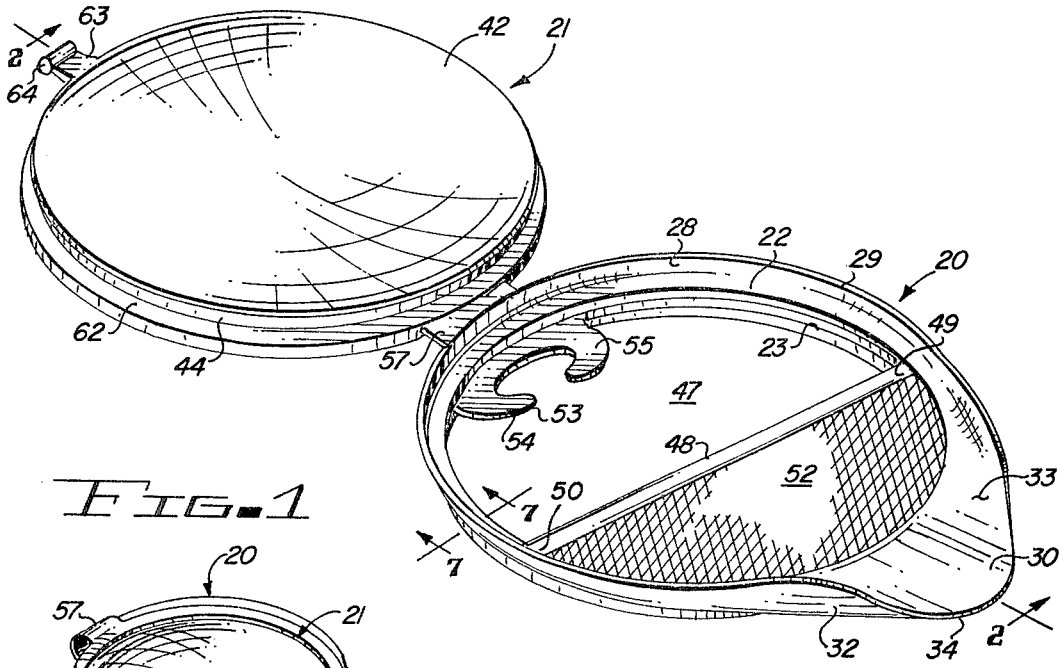
FIG. 1 is a perspective view of an attachment for liquid carrying containers, constructed in accordance with the teachings of the instant invention.
Figure 2:
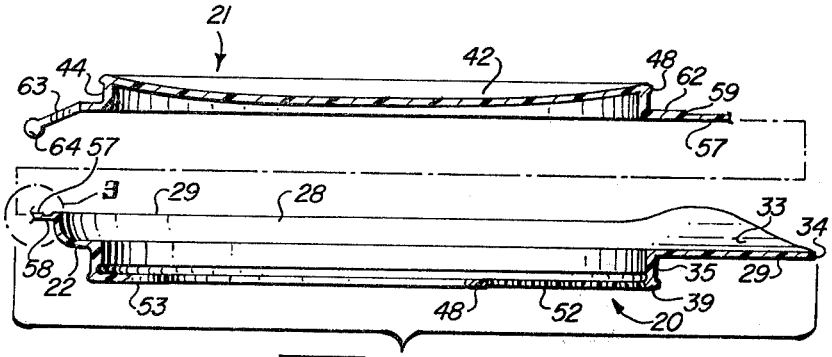
FIG. 2 is a vertical sectional view taken along the line 2—2 of FIG. 1, the components being broken and rearranged due to space limitations.

Turning now to the drawings in which like reference characters indicate corresponding elements throughout the several views, attention is first directed to FIG. 1, which shows an attachment constructed in accordance with the teachings of the instant invention and having a body member, generally designated by the reference character 20 and a closure member, generally designated by reference character 21. Body member 20, as is further illustrated in FIGS. 2 and 3, includes an annular ledge 22, having an inner peripheral edge 23, an outer peripheral edge 24, and top and bottom surfaces 25 and 27, respectively. Rim 28 extends upwardly from top surface 25 at outer peripheral edge 24 of ledge 22 and concludes with terminal edge 29.

Pouring spout 30 extends radially from ledge 22 and is continuous therewith. Pouring spout 30 has upturned side portions 32 and 33 which converge in a direction away from ledge 22. Terminal edge 34 of pouring spout 30 is continuous with terminal edge 29 and of rim 28, being semi-annular.

Figure 3:
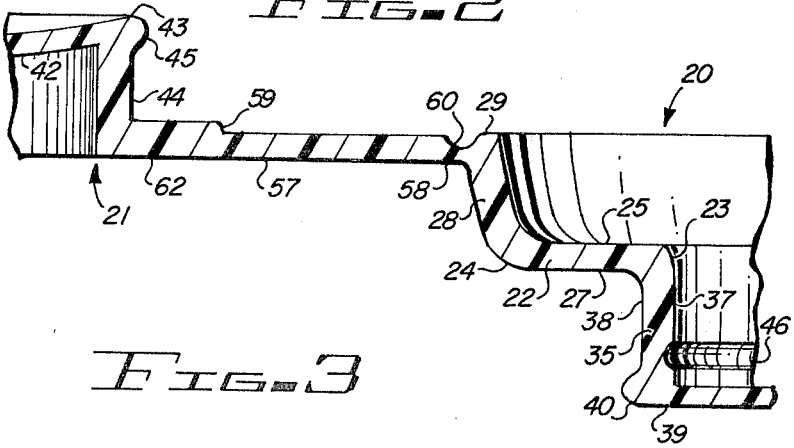
FIG. 3 is an enlarged vertical sectional view of the fragmentary section indicated in FIG. 2.

Depending from body 20 are engagement means. The engagement means, as seen in FIG. 3, is in the form of a generally cylindrical projection 35 having inner and outer surfaces 37 and 38, respectively, and a lower edge 39. An annular lip 40 is carried on outer surface 38 proximate lower edge 39. The immediate engagement means, as well as alternate embodiments thereof, will be presently described in further detail.

Closure member 21 includes a generally circular panel 42 having a peripheral edge 43. Cylindrical skirt 44 encircles panel 42 at peripheral edge 43. In the closed position, closure member 21 is received within annular ledge 22. Various sealing means between body member 20 and closure member 21 are envisioned. Skirt 44 may sealingly engage against inner peripheral edge 23 of ledge 22, or against inner surface 27 of cylindrical projection 35. The immediate embodiment illlustrates an annular bead 45 carried at the junction of panel 42 and skirt 44 which is tightly received against inner surface 37 of cylindrical projection 35. Bead 45 is received in annular recess 46 carried on inner surface 37 of projection 35 when closure member 21 is in the closed position.

Inner peripheral edge 23 of ledge 22 defines an opening 47 which extends through body member 20. An elongate bar 48 extends across opening 47 in a manner analogous to the cord of a circle. The ends 49 and 50 of bar 48 are illustratively attached to the inner surface 37 of projection 35. The exact point of attachment of ends 49 and 50 is relatively unimportant within the spirit of the invention. For example, ends 49 and 50 may be attached to ledge 22 and retain the desired function of bar 48. In the immediate embodiment, bar 48 is spaced from, and generally perpendicular to, pouring spout 30.

Segmentally shaped screen 52 spans that portion of opening 47 between bar 48 and spout 30.

Brush holder 53 is also secured to the inner surface 37 of cylindrical projection 35 and resides within opening 47. Brush holder 53 includes a pair of opposed arcuate fingers 54 and 55 which engages the small portion of the shank of a brush handle below the end grip portion, such that the bristle portion of the brush depends downwardly therefrom.

A hinge 57, having first and second ends 58 and 59, extends between body member 20 and closure member 21. First end 58 is affixed to rim 28 proximate terminal edge 29. Second end 59 is affixed to skirt 44. Indentation 60 extends laterally across hinge 57 proximate first end 58 to provide a selective bending line. It will be appreciated that a given length of hinge 57 is necessary to carry closure member 21 across ledge 22 for positioning of skirt 44 through the inner peripheral edge 23 of ledge 22. Flange 62, extending radially from skirt 44, resides over ledge 22 with closure member 21 in the closed position.

Pull tab 63 extends from closure member 21 and terminates with an enlarged bead 64 which facilitates grasping, as is normally accomplished with the thumb and index finger. Pull tab 63 extends radially from flange 62 and is positioned to reside over spout 30 in the closed position.

Preferably, the foregoing described attachment is integrally molded of a plastic compound, such as polypropylene. The entire structure may be characterized as being semi-rigid or semi-flexible, either term having the same meaning. The rigidity is sufficient that the structure will retain shape and function as intended. On the other hand, flexibility is sufficient that the domed top will assist in providing a seal between body member 20 and closure member 21. Further, due to the flexibility, closure member 21 may be "peeled" open as tab 63 is lifted and urged in a direction away from pouring spout 30. The flexible rigidity, or flexibility, is proportional to material thickness. Indentation 60 increases local flexibility and insures folding along the line of the indentation. Other suitable materials exhibiting the desired characteristics will readily occur to those skilled in the plastic art.

Figure 4:
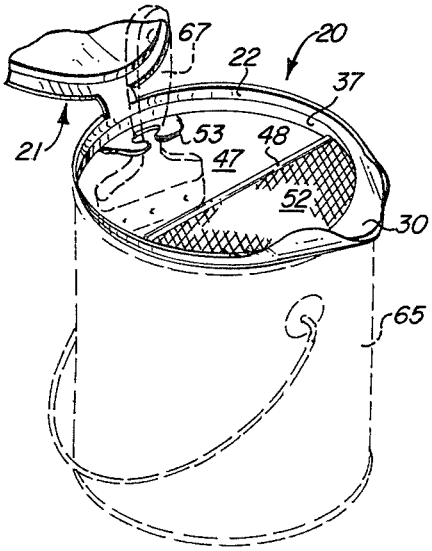
FIG. 4 is a view generally corresponding to the illustrations of FIG. 3 and showing the attachment in open position.

FIG. 4 graphically illustrates the foregoing described attachment as it would appear when attached to a liquid carrying container as shown in the broken outline 65. A brush 67, also shown in broken outline, is held by brush holder 53. While the bristle portion of brush 67 hangs downwardly into the liquid, the handle portion thereof extends upwardly where it can be readily grasped and kept free of liquid. As brush 67 is withdrawn from container 65, excess liquid can be readily wiped from brush 67 by stroking the bristles across bar 48. It is also apparent from the illustration that liquid is readily poured by tipping the can and allowing the liquid to flow over pouring spout 30. Liquid passing over pouring spout 30 first passes through screen 52 where any particulate matter in the liquid is strained therefrom and retained within container 65.

Figure 5:
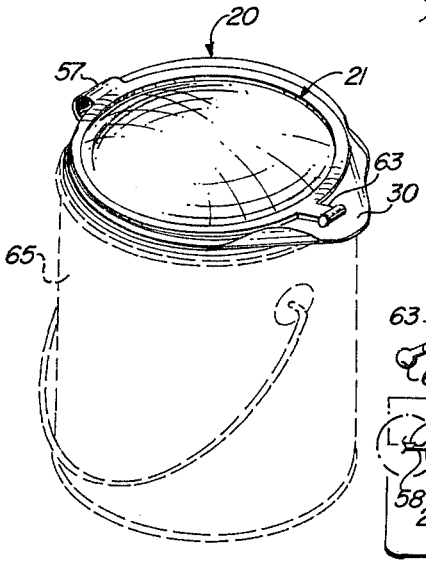
FIG. 5 is a perspective view of the device of FIG. 1 as it would appear when engaged with the brim of a container and in the closed position, the container being shown in broken outline.
Figure 6:
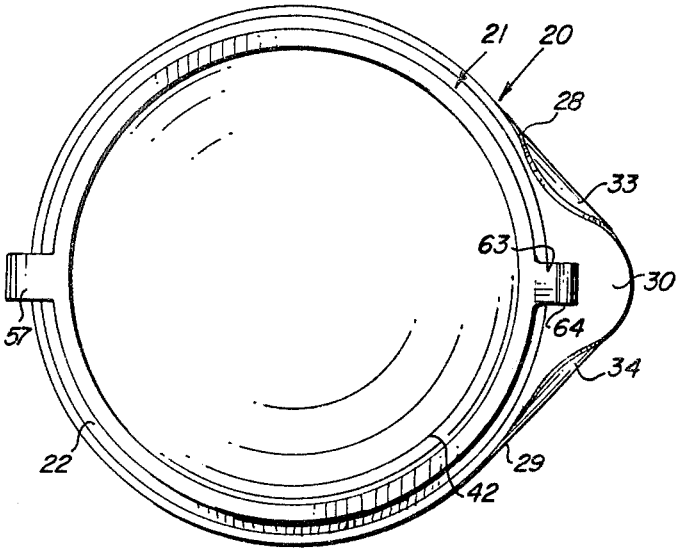
FIG. 6 is a plan view of the device of FIG. 1, and shown in the closed position.

FIGS. 5 and 6 illustrate the foregoing described attachment assembled with container 65 and in the closed position. After use is completed, as illustrated in FIG. 4, closure member 21 is simply urged in a direction over body member 20, causing a fold in hinge 57 and indentation 60 and sealingly engaged therewith. The container, with the fluid heremtically sealed therein, is immediately ready for storage. At the time of subsequent use, tab 63 is grasped and the attachment returned to the configuration as seen in FIG. 4. It is recommended, but not absolutely necessary, that the excess liquid be wiped from top surface 25 of ledge 22. A slight slope of surface 25 downwardly from outer peripheral edge 24 toward inner peripheral edge 23 will insure a continuous redirection into the container of any liquid which is spilled or splashed into the area.

Figure 7:
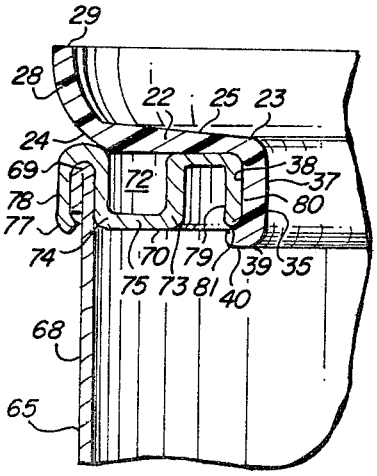
FIG. 7 is an enlarged vertical sectional view taken along the line 7—7 of FIG. 1 and specifically illustrating a preferred means for attaching the container of the instant invention to the brim of the container.

FIG. 7 illustrates the construction of a typical container of the type generally used for carrying liquids such as paint and cooking oil. The container 65 is generally cylindrical, having an upright continuous sidewall 68 with a closed bottom (not shown) and an upper edge 69. A brim 70 is carried at the top of sidewall 68. Brim 70 includes an annular gutter 72 formed by opposed inner and outer sidewalls 73 and 74, respectively, and bottom 75. Outer peripheral wall 77 cooperates with sidewall 74 of gutter 72 for grasping the top portion of sidewall 68 and retaining the assembly which is usually crimped together. Outer peripheral wall 77, has an outer peripheral surface 78. Inner peripheral wall 79, having inner peripheral surface 80 and lower edge 81 normally engages the lid, (not herein shown) supplied by the manufacturer. The conventional standard lid may also incorporate an element which depends into gutter 72.

In accordance with conventional practice, as liquid is dispensed from the interior of the container, either as result of brushing, dipping or pouring, the liquid passes over inner periperal surface 80 and gutter 72. The liquid accumulates in gutter 72 and eventually overflows down the exterior side of sidewall 68, creating a mess on the container and the immediate environment. Liquid within the gutter 72, generally must be removed prior to replacement of the lid. Further, liquid accumulated in gutter 72, or spilled over the side of the container, represents a loss of material. Ledge 22 resides over gutter 72 preventing the accumulation of liquid therein. Further, due to the sealing engagement between outer surface 38 of cylindrical projection 35 and the engagement of annular lip 40 under lower edge 81 seepage is retarded, as when the can is tipped during pouring, into gutter 72.

Figure 8:
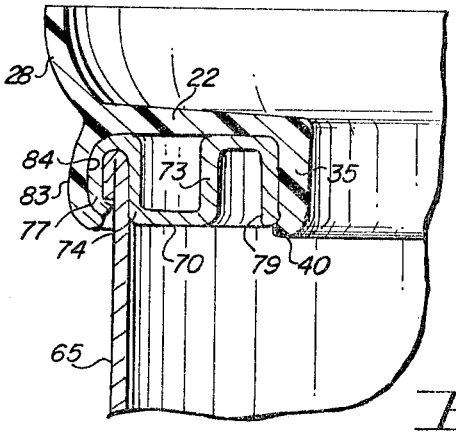
FIG. 8 is a view generally corresponding to the view of FIG. 7 and illustrating an alternate attachment means.

FIG. 8 illustrates an alternate engagement means in the form of a second generally cylindrical projection 83 depending from ledge 22 and concentrically spaced from 35. Second cylindrical projection 83 has an inner surface 84 which seals against the outer peripheral surface 78 of outer peripheral wall 77. Hence, the entire brim 70 is closely received between cylindrical projections 35 and 83.

Figure 9:
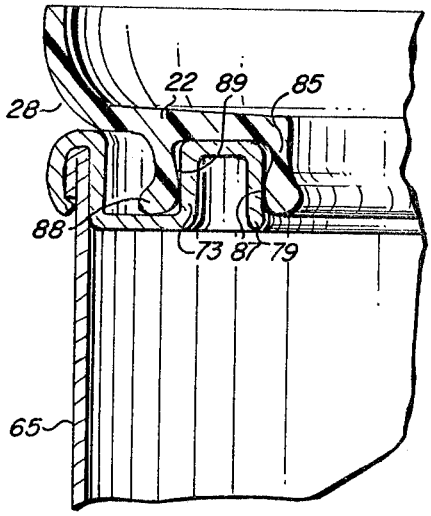
FIG. 9 is an illustration generally corresponding to the view of FIG. 7 and showing a further alternate attachment means useful in connection with the instant invention.

FIG. 9 illustrates another embodiment of engagement means having a cylindrical projection 85 which, in general similarity to projection 35, has an outer surface 87 which seals against the inner surface of inner peripheral wall 79. Another projection 88 depends from ledge 22 intermediate the ends thereof and is concentric with cylindrical projection 85. Projection 88 is received in gutter 72 and has an inner surface 89 which is received against inner sidewall 73. The gripping of brim by projections 85 and 88 is generally analogous to the gripping of brim 70 by projections 35 and 83.

Figure 10:
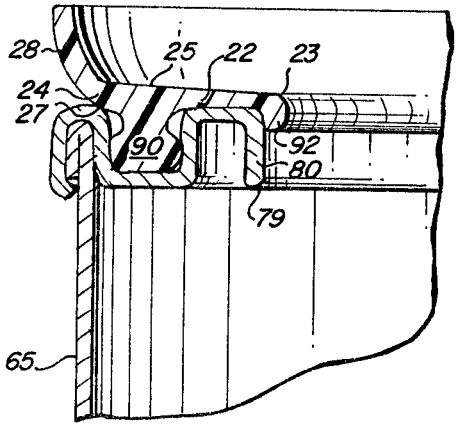
FIG. 10 is another view generally corresponding to the view of FIG. 7 and showing yet a further alternate embodiment of an attachment means of the present invention.

Yet another alternate attachment means is seen in FIG. 10. An annular bead 90 depends from the undersurface 27 and is received in gutter 72. Bead 90 is sized to be sligthly compressed during insertion into gutter 72 and frictionally retained between sidewalls 73 and 74. Lip 92 extends downwardly from inner peripheral edge 23 of ledge 22 against the inner peripheral surface 80 of wall 79. Lip 92 assists in redirecting liquid from surface 25 of ledge 22 into the container and, due to the sealing engagement between lip 92 and surface 80, prevents seepage of fluid toward gutter 72, especially when the container is tipped as during pouring.

A further embodiment of the invention is seen in FIG. 11. The immediate embodiment includes a body member generally designated by the reference character 110 and a closure member generally designated by the reference character 112. In general similarity to the previously described embodiments, body member 110, as also seen in FIGS. 12 and 14 includes annular ledge 113, having inner peripheral edge 114, outer peripheral edge 115, and top and bottom surfaces 117 and 118, respectively. Rim 119 extends upwardly from top surface 117 of ledge 113 and concludes with terminal edge 120.

Pouring spout 122, extends radially from ledge 113 and is continuous therewith. Rim 115 is continuous about ledge 113 and pouring spout 112. In the immediate embodiment, pouring spout 122 need not necessarily have upturned sides or the arcuate cross section of previously described pouring spout 30. The portion of rim 115, adjacent pouring spout 122, provides a function analogous to previously described upturned side portions 32 and 33. An inwardly directed bead 123, as will be presently described in greater detail, is carried proximate terminal edge 120 of rim 119.

A pouring lip 124 is carried proximate the outer edge of pouring spout 112. Pouring lip 124 is formed by a substantially horizontal surface 125 extending outwardly from proximate the terminal edge 120 of rim 119 and a lower surface 127 extending downwardly inward from upper surface 125. Surfaces 125 and 127 meet at outwardly directed relatively sharp apex 128. Pouring lip 124, will not interfere with the flow of liquid being poured from the container, and passing over pouring spout 122. Pouring a liquid from a container, having the device of the instant invention attached thereto, is accomplished in accordance with the conventional method of tipping the container in a direction toward pouring lip 22. The pouring operation is terminated by returning the container to an upright position. Experimentation has shown that a pouring lip shaped in accordance with pouring lip 124, will immediately sever the stream of fluid being poured and prevent the dribbling of fluid from the end of the pouring spout.

An alternate container 129, typical of commercially available containers is illustrated in FIGS. 12 and 14. Container 129, in general similarity to the previously described container, includes a continuous sidewall 130, having a top or upper edge 132. Brim 133 is secured to sidewall 130 proximate top 132. Brim 133 includes an annular gutter 134 formed by opposed inner and outer sidewalls 135 and 137. Brim 133 further includes an inner peripheral surface 138, having top and bottom edges 139 and 140, respectively, and an outer peripheral surface 142 having top and bottom edges 143 and 144, respectively. In accordance with conventional construction techniques, familiar in the container art, top edge 132 of sidewall 130 is crimped between outer sidewall 137 and outer peripheral surface 142 forming an outwardly projecting annular bead.

Engagement means for detachably securing body member 110 to container 129, includes continuous projection 145, having inner surface 147, outer surface 148, and lower edge 149 depending from ledge 113. Annular groove 150, formed in inner surface 147, receives the enlargement created by outer peripheral surface 142 of brim 133 and forms inwardly directed lip 152, which engages under bottom edge 144 of outer peripheral surface 142. The distance from lip 152 to the bottom surface 118 of ledge 113 is such that the engagement of lip 152 under edge 144 exerts a downward force sealingly bearing bottom surface 118 against top edge 139 of brim 133. The downward force is sufficient to resist the seepage of liquid between edge 139 and surface 118. Fabrication of the device of the instant invention from an appropriate material, such as polypropylene, will insure the foregoing sealing engagement as will be readily understood by those skilled in the art.

Closure member 112, as seen in FIGS. 11 and 12, includes panel 153, having peripheral edge 154. In the immediate illustrations, closure member 112 is viewed in the open position and for purposes of orientation is considered to be upsidedown. Accordingly, panel 153 has a bottom surface 155, and a top surface 157. Continuous skirt 158, projects from bottom surface 155 proximate peripheral edge 154.

Skirt 158 terminates with outwardly directed bead 159. In the closed position, as viewed in FIG. 13, bead 159 is passed through bead 123 of rim 119 by snap engagement to sealingly engage closure member 112 with body member 110 for the purpose of hermetically sealing the liquid within container 129. The sealing engagement is continuous about ledge 113 including pouring spout 122. Ledge 113, including pouring spout 122, slopes downwardly in a direction away from outer peripheral edge 115 toward inner peripheral edge 114. The sealing engagement between rim 119 and bead 159 is at a position elevated above top surface 117 of ledge 113. Accordingly, it is not necessary to remove liquid from ledge 117 prior to closing closure member 112 and, further liquid upon ledge 113 will drain and return to container 129 after closure member 112 is so closed.

As in the previously described embodiments, body member 110 and 112 are joined by hinge 160, having first end 162 affixed to rim 119 and a second end 163 affixed to panel 153. Indentation 164, extends laterally across hinge 160 intermediate ends 162 and 163 to provide a selective bending line. The device is closed by pivotal movement being along indentation 164, and exerting downward force upon closure member 112 proximate peripheral edge 154 of panel 153. To facilitate opening, closure member 112 may be provided with pull tab 165, formed by a length of panel 153, projecting beyond skirt 158.

A straining element, generally designated by reference character 167 as viewed in FIG. 15, is detachably engagable to body member 110, intermediate the opening provided by inner peripheral edge 114 of ledge 113 and pouring spout 122 for removing solid masses and other contaminates from the liquid within container 129 during pouring. In accordance with a preferred embodiment of the instant invention, straining element 167 includes a semi-circular foraminous section 168 and a reinforcing bar 169. A brush wiping bar, 170, extends across ledge 113 and includes first and second ends 172 and 173, respectively, attached to inner peripheral surface 114. The structure and function of bar 170 is analogous to the previously described bar 48. Notches 174 and 175 are sized and shaped to receive brush wiping bar 170 and the distance between notches 174 and 175 is greater than the distance between ends 172 and 173.

Preferably straining element 167 is fabricated of flexible and resilient material and in a preferred embodiment is molded of polypropylene consistant with the fabrication of body member 110 and closure member 112. As will be readily recognized by those skilled in the art, straining element 167 may be molded such that foraminous section 168 gives the appearance of having a first plurality of parallel rows 177 of substantially straight members and an angularly displaced second arrangement of parallel rows 178 which define a plurality of openings 179.

Preparatory to use, an arcuate shape is imparted to straining element 167 as seen in FIG. 16. The arcuate shape is imparted by manual manipulation on the part of the user. Straining element 167 is then lowered to body member 110 and notches 174 and 175 passed over bar 170. Upon release of pressure by the user, the inherent resilient characteristics of element 167, tend to straighten the element urging mothches 174 and 175 toward respective ends 172 and 173 of bar 170. Since the spacing between notches 174 and 175 is greater that the distance between ends 172 and 173, an arcuate shape is retained within element 167 urging the element against the portion of inner peripheral edge 114 defined between ends 172 and 173. Accordingly, foraminous section 168 intercepts substantially all liquid as it passes from within container 127 to pouring spout 122. Removal is accomplished by urging element 167 in an upwardly direction away from body element 110.

FIG. 12 illustrates a finger 180 projecting from bottom surface 155 of panel 153. Finger 180 is sized to be received in snap or frictional engagement within an opening 179. For purposes of storage, as illustrated in FIG. 17, straining element 167 is placed against bottom surface 155 of panel 153 with finger 180 passing through a selected opening 179. It will be appreciated that straining element 167 may be stored as described while still wet with liquid, the liquid draining onto panel 153 when closure member 112 is in the open position and alternately draining into container 129 when closure member 112 is in the closed position. Alternately, straining element 167 may be cleansed by any common method intermediate the use and storage thereof.

Various changes and modifications to the devices herein chosen for purposes of illustration will readily occur to those skilled in the art. To the extent that such modifications and variations do not depart from the spirit of the invention, they are intended to be included within the scope thereof which is assessed only by a fair interpretation of the appended claims.

Having fully discribed and disclosed the present invention, and alternately preferred embodiments thereof, in such clear and concise terms as to enable those skilled in the art to understand and practice the same, the invention claimed is:

1. An attachment for use in combination with a liquid carrying container, which container includes an annular brim carrier proximate the top of an upright continuous sidewall, said brim having an inner peripheral surface with a bottom edge, an outer peripheral surface with a bottom edge and a gutter having inner and outer opposed sidewalls intermediate said peripheral surfaces, said attachment comprising:

(a) a body member including
- i. a continuous annular ledge extending over said gutter and having an inner edge defining an opening therethrough, an outer edge, and top and bottom surfaces,
- ii. engagement means depending from bottom surface of said ledge for detachably securing the body member to the brim of said container,
- iii. a pouring spout having a top surface and extending radially outward from said ledge and having an outer edge, said spout having an axis of symmetry,
- iv. a rim upstanding from the top surface of said ledge and pouring spout proximate the outer edges thereof and having a terminal edge,
- v. a brush wiping bar formed integral with the ledge of said body and substantially perpendicular to the axis of symmetry of the pouring spout, and
- vi. a liquid straining element detachably securable to said brush wiping bar and having a plurality of apertures therethrough for passage of liquid through the opening in said ledge to said pouring spout; and (b) a closure member including
- i. a panel having top and bottom surfaces and a peripheral edge, and
- ii. a continuous skirt projecting from the bottom surface of said panel proximate the peripheral edge thereof, and detachably engagable with the rim of said body member for sealingly closing the container; and (c) hinge means including
- i. a first end affixed to said body member, and
- ii. a second end affixed to said closure member.

2. The attachment of claim 1, further including a finger projecting from the bottom surface of the closure member within the area defined by the skirt of said closure member and engagable within a selected one of said plurality of apertures of said straining element for detachably securing said straining element.

* * * * *